US010582783B1

(12) United States Patent
Hill

(10) Patent No.: US 10,582,783 B1
(45) Date of Patent: Mar. 10, 2020

(54) DECORATIVE PILLOW COVER ASSEMBLY CONCEALING A SLEEPING PILLOW

(71) Applicant: Panzina Elizabeth Hill, Coral Springs, FL (US)

(72) Inventor: Panzina Elizabeth Hill, Coral Springs, FL (US)

( * ) Notice: Subject to any disclaimer, the term of this patent is extended or adjusted under 35 U.S.C. 154(b) by 306 days.

(21) Appl. No.: 15/464,304

(22) Filed: Mar. 20, 2017

Related U.S. Application Data

(60) Provisional application No. 62/313,844, filed on Mar. 28, 2016.

(51) Int. Cl.
*A47G 9/02* (2006.01)
*A47G 9/10* (2006.01)
*A47G 9/04* (2006.01)

(52) U.S. Cl.
CPC ..... *A47G 9/0253* (2013.01); *A47G 9/04* (2013.01); *A47G 9/10* (2013.01)

(58) Field of Classification Search
CPC ..... A47G 9/0253; A47G 9/04; A47G 9/10
USPC ..... D6/601
See application file for complete search history.

(56) References Cited

U.S. PATENT DOCUMENTS 1,261,314 A 4/1918 Stoddard
2,637,860 A 5/1953 Lehigh
3,241,161 A 3/1966 Dashosh
D236,063 S * 7/1975 Kesh ..... D6/601
4,604,765 A 8/1986 Schultz
4,864,669 A * 9/1989 Jones ..... A47G 9/0253 5/636
D353,073 S * 12/1994 Birk ..... D6/596
7,013,509 B2 3/2006 Hickman
8,011,038 B2 * 9/2011 Balasundharam ... A47G 9/0238 5/482
8,448,273 B2 5/2013 Walker et al.
8,458,832 B1 6/2013 Krishna
8,943,626 B1 * 2/2015 Stephens ..... A47C 21/026 5/490
9,913,551 B1 * 3/2018 Baker ..... A47G 9/04
2007/0256241 A1 11/2007 Harmon
2008/0045114 A1 * 2/2008 Milbourne ..... A47C 21/026 446/72
2008/0235877 A1 * 10/2008 Murray ..... A47G 9/10 5/640
2009/0293198 A1 * 12/2009 Fodge ..... A47C 31/10 5/653
2011/0023235 A1 2/2011 Gold
(Continued)

*Primary Examiner* — Eric J Kurilla
*Assistant Examiner* — Myles A Throop
(74) *Attorney, Agent, or Firm* — John Rizvi; John Rizvi, P.A.—The Patent Professor

(57) ABSTRACT

A decorative pillow cover assembly for converting a sleeping pillow into a decorative pillow is provided including a decorative pillow cover including a first cover portion and a second cover portion which can be hinged to one another, or fully separable from one another. A pillow securing device can be formed on an internal surface of the second cover portion for securing the sleeping pillow inside a space formed between the first cover portion and the second cover portion. A cover securing device can be provided along edges of the first cover portion and the second cover portion for securing the first cover portion and the second cover portion together. Additionally, a peripheral decorative flap can be removably attached to a periphery of the decorative pillow cover.

19 Claims, 8 Drawing Sheets

(56) References Cited

U.S. PATENT DOCUMENTS

| | | | | |
|---|---|---|---|---|
| 2013/0263377 | A1* | 10/2013 | Wootten, Jr. ..... | A47C 23/00 5/640 |
| 2014/0000037 | A1* | 1/2014 | Donohue ..... | A47G 9/0253 5/639 |
| 2015/0113734 | A1* | 4/2015 | Arabo ..... | A47G 9/0223 5/645 |

* cited by examiner

DECORATIVE PILLOW COVER ASSEMBLY CONCEALING A SLEEPING PILLOW

CROSS-REFERENCE TO RELATED APPLICATIONS

This application claims the benefit of U.S. Provisional Patent Application Ser. No. 62/313,844, filed on Mar. 28, 2016, which is incorporated by reference herein in its entirety.

FIELD OF THE INVENTION

The present invention relates generally to bedding accessories, and more particularly, to a decorative pillow cover assembly that can house a sleeping pillow so as to easily and quickly convert the sleeping pillow into a decorative pillow and vice versa.

BACKGROUND OF THE INVENTION

Pillows have been around since prehistoric times, where the first pillows were carved out of raw wood or stone in such a way that the head could be resting off the ground in order to prevent insects from crawling on the body and into mouths, noses, and ears. As the centuries turned, pillows became more comfortable and more elegant by using different materials and more defined craft. They were used by wealthy people for not just resting and refreshment, but as a status symbol to show they were among the elite of their society. The number of pillows possessed by a family or individual was thought to be an indication of their social standing. It was many more years before pillows evolved to the point where they became standard bedding and household accessories used widely in homes and hotels. Pillows started to be mass manufactured around the time of the Industrial Revolution, and finally, an average person could enjoy a better night's sleep. Today, pillows are used for, among other things, sleeping, health, beauty and room decoration. The various ways pillows can be used for these purposes are limited only by the imagination.

Most pillow uses fall into two categories: sleeping pillows for providing support and comfort during sleep, and specially-designed decorative pillows for ornamental purposes. In a typical bed setting, sleeping pillows and decorative pillows can both be used. In many cases, the bedspread or bed cover will go over the sleeping pillow, and then the decorative pillow will be placed on top of that.

A sleeping pillow is normally formed by a pillow and a pillowcase providing a soft texture and protecting the pillow, which is filled with down, feathers, or other soft filling materials. The pillowcase typically matches the bed sheets. A sleeping pillow is normally intended for the resting of a person's head while sleeping.

Decorative pillows, in turn, are normally comprised of a pillow and a decorative cover. The purpose of decorative pillows is to beautify the bed when made, rather than to serve as a headrest; in some circumstances, such as in hotel settings, individuals will use the decorative pillows as a prop to sit up while reading and watching television. Decorative pillows can have designs or patterns that match a duvet, a blanket, or the general décor of the room. When going to bed, the user typically removes or tosses the decorative pillows from the bed and sleeps using the sleeping pillow(s) only.

Such a typical bed setting comprising both sleeping pillows and decorative pillows typically requires users to have at least four pillows in a two-person bed, such as a queen- or a king-sized bed. As known, pillows can be expensive, especially high quality pillows used in luxury homes and hotels. As a consequence, the aforementioned typical bed setting may require a significant monetary investment, depending upon the pillow quality. Also, it is inconvenient that users have to remove the decorative pillows when going to bed and then have to put them back when making the bed after getting up.

Conceivably, it is possible to use a single pillow as both a sleeping pillow and a decorative pillow so that only two, not four, pillows would be needed in the above-described bed setting. However, typical decorative pillows are not suitable for sleeping as they are often too rigid to be comfortable, as anyone who sleeps in a hotel can attest. In turn, the typical sleeping pillows are not suitable for decoration for sanitary reasons, since pillows can attract germs, dust and small insects, and therefore sleeping pillows should be well protected from the outside environment, rather than more exposed, to reduce the threat of potential contamination while not being used for sleeping. Therefore, if both sleeping and decoration are desired, more pillows need to be purchased, adding to the expense of keeping a household or a business.

Accordingly, there is an established need for a bedding arrangement which solves at least one of the problems mentioned heretofore. For instance, there is an established need for a more cost effective, yet equally functional sleeping and decorative pillow arrangement.

SUMMARY OF THE INVENTION

The present invention is directed to a convenient and cost effective decorative pillow cover assembly that is capable of easily converting a sleeping pillow into a decorative pillow and vice versa whenever it is needed. The decorative pillow cover assembly includes an outer decorative cover that can house a sleeping pillow in an easily removable manner, allowing a user to convert a decorative pillow into a sleeping pillow prior to sleeping, and to convert it back into a decorative pillow when making the bed.

In a first implementation of the invention, a decorative pillow cover assembly for converting a sleeping pillow into a decorative pillow includes a decorative pillow cover having a first cover portion and a second cover portion. A pillow securing device is formed on an internal surface of the second cover portion for securing a sleeping pillow inside an internal space formed between the first cover portion and the second cover portion. A cover securing device is provided along edges of the first cover portion and the second cover portion for disconnectably securing the edges of the first cover portion and the second cover portion together and enclosing the internal space and the pillow securing device.

In a second aspect, the decorative pillow cover assembly can further include a sleeping pillow comprising a pillowcase and a pillow encased within the pillowcase. The sleeping pillow can be arranged within the internal space and retained adjacent to the second cover portion by the pillow securing device. The sleeping pillow can also be extracted from the decorative pillow cover by disconnecting the cover securing device, moving the first and second cover portions, disengaging the pillow securing device and removing the sleeping pillow from the internal space.

In another aspect, the first cover portion and the second cover portion are foldably connected to one another. Alternatively, the first cover portion and the second cover portion can be separably and re-connectably connected to one another.

In another aspect, the pillow securing device can include one or more flexible strap fasteners. The strap fasteners can be adjustable, to regulate the tension exerted by the strap fasteners against the sleeping pillow and adjust to different sleeping pillow sizes.

In another aspect, the pillow securing device can include a panel forming a pocket configured to receive the sleeping pillow therewithin.

In yet another aspect, the cover securing device can include a zipper and/or a snap fastener. Alternatively or additionally, other disconnectable and re-connectable fasteners may be used, such as, but not limited to, magnets, buttons, or the like.

In another aspect, the first cover portion and the second cover portion can be connected at one side thereof, and the cover securing device can be provided along edges of the remaining sides of the first cover portion and the second cover portion. In other embodiments, the cover securing device can be provided along edges of all sides of the first cover portion and the second cover portion.

In another aspect, the decorative pillow cover assembly can further include a peripheral flap removably attachable to a periphery of the decorative pillow cover. The peripheral flap can be removably attachable to the periphery of the decorative pillow cover by snap fasteners, for instance and without limitation.

In another aspect, the decorative pillow cover assembly can further include a decorative frame comprising a set of one or more openings for the passing therethrough of the cover securing device. The decorative pillow cover assembly can adopt an assembled configuration in which the decorative frame is sandwiched between the first cover portion and the second cover portion and the cover securing device extends through the set of one or more openings securing the first cover portion to the second cover portion and securing the frame to the decorative pillow cover. The decorative pillow cover assembly can further adopt a disassembled configuration in which the cover securing device is disconnected allowing the removal of the frame from in between the first cover portion and second cover portion.

In another implementation of the invention, a decorative pillow cover assembly for converting a sleeping pillow into a decorative pillow includes a sleeping pillow and a decorative pillow cover. The sleeping pillow comprises a pillow and a pillowcase encasing the pillow. In turn, the decorative pillow cover includes a first cover portion, a second cover portion, a pillow securing device and a cover securing device. The pillow securing device is formed on the second cover portion facing the first cover portion. The cover securing device is provided along edges of the first cover portion and the second cover portion for disconnectably securing the edges of the first cover portion and the second cover portion together and enclosing an internal space therebetween and further enclosing the pillow securing device. The decorative pillow cover assembly can adopt a decorative configuration and an open configuration. In the decorative configuration, the sleeping pillow is housed within the internal space of the decorative pillow cover and retained against the second cover portion by the pillow securing device, and the first cover portion and second cover portion are attached to one another by the cover securing device, thereby enclosing the sleeping pillow. In the open configuration, the cover securing device is disconnected, the first cover portion and second cover portion are moved away from one another, and the pillow securing device is released allowing the removal of the sleeping pillow to be used for resting a user's head thereon for sleeping.

Introducing another embodiment of the invention, the present invention consists of a method of converting a sleeping pillow into a decorative pillow, comprising the steps of:

providing a decorative pillow cover assembly including a decorative pillow cover having a first cover portion and a second cover portion, a pillow securing device formed on an internal surface of the second cover portion for securing the sleeping pillow inside an internal space formed between the first cover portion and the second cover portion, and a cover securing device provided along edges of the first cover portion and the second cover portion for securing the edges of the first cover portion and the second cover portion together and enclosing the internal space and the pillow securing device;

placing the sleeping pillow in the internal space;

securing the sleeping pillow within the internal space using the pillow securing device; and securing the first cover portion and the second cover portion together using the cover securing device.

In another aspect, the method further includes the step of removably attaching a peripheral decorative flap to a periphery of the decorative pillow cover.

In another aspect, different peripheral decorative flaps can be interchangeably attached to the decorative pillow cover.

In another aspect, the peripheral decorative flap is removably attached to the periphery of the decorative pillow cover by snap fasteners.

In another aspect, the method can further include the steps of sandwiching a decorative frame between the first cover portion and the second cover portion, extending the cover securing device through a set of one or more openings comprised in the frame, and fastening the cover securing device, thereby securing the first cover portion to the second cover portion and securing the frame to the decorative pillow cover by.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a convenient and cost effective decorative pillow cover assembly that is capable of easily converting a sleeping pillow formed by a pillow and a pillowcase into a decorative pillow and vice versa whenever it is needed so that separate sleeping pillows and decorative pillows are not required.

Figure 1:
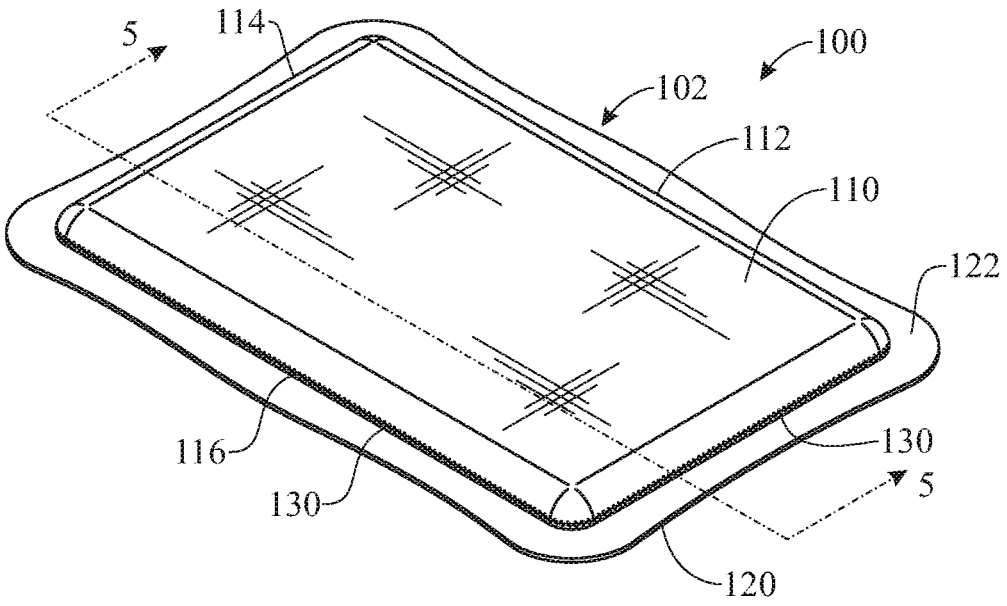
FIG. 1 presents a top isometric view of a decorative pillow cover assembly in accordance with a first exemplary embodiment of the present invention, where the zipper is closed.
Figure 2:
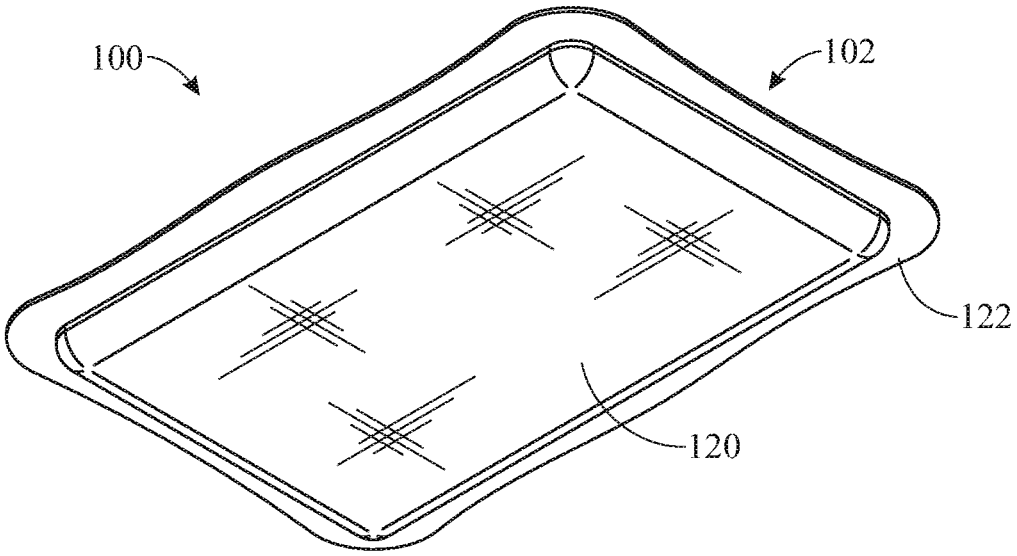
FIG. 2 presents a bottom isometric view of the decorative pillow cover assembly of FIG. 1.
Figure 3:
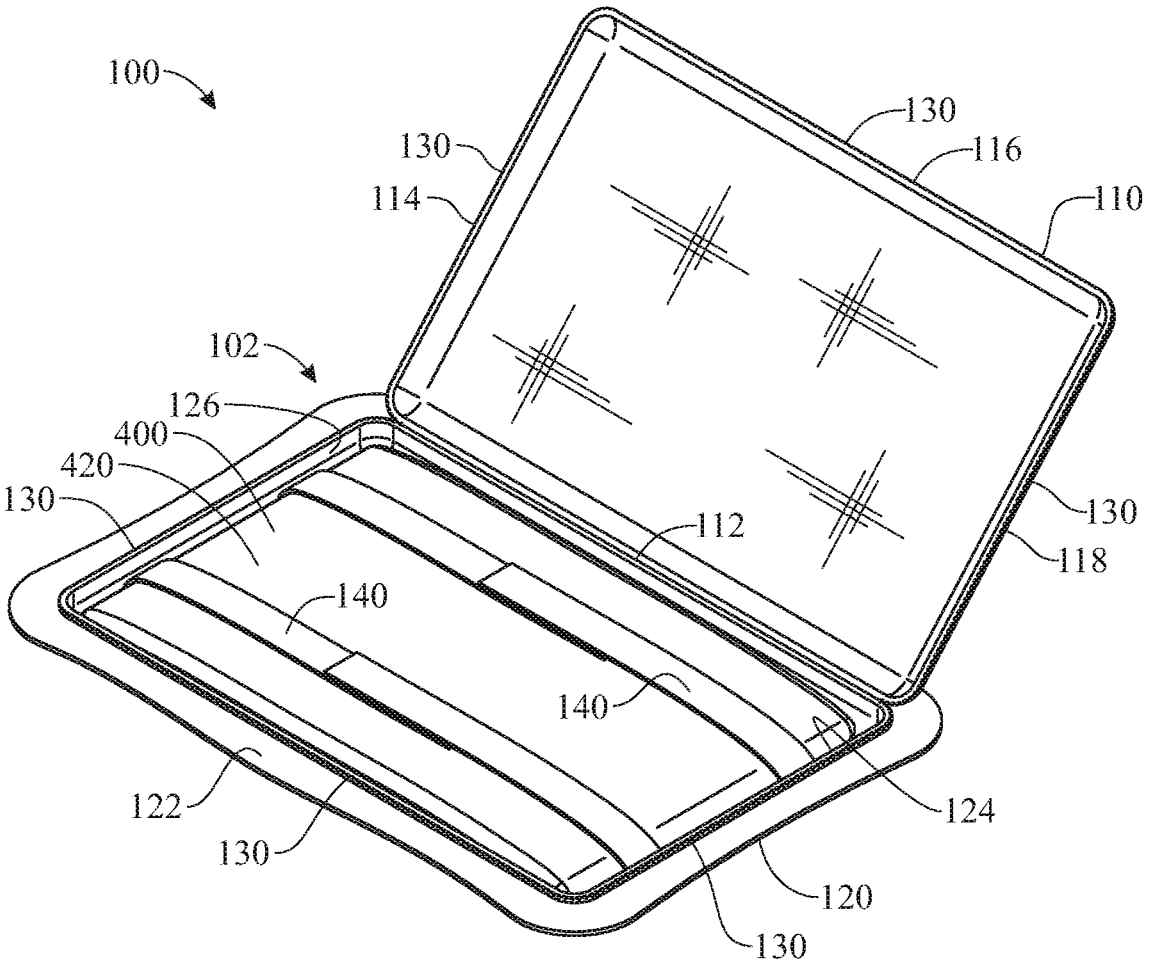
FIG. 3 presents a top isometric view of the decorative pillow cover assembly of FIG. 1, where the zipper is unzipped and the first cover portion is pivoted to an open position, and a sleeping pillow is shown housed inside the decorative pillow cover.
Figure 4:
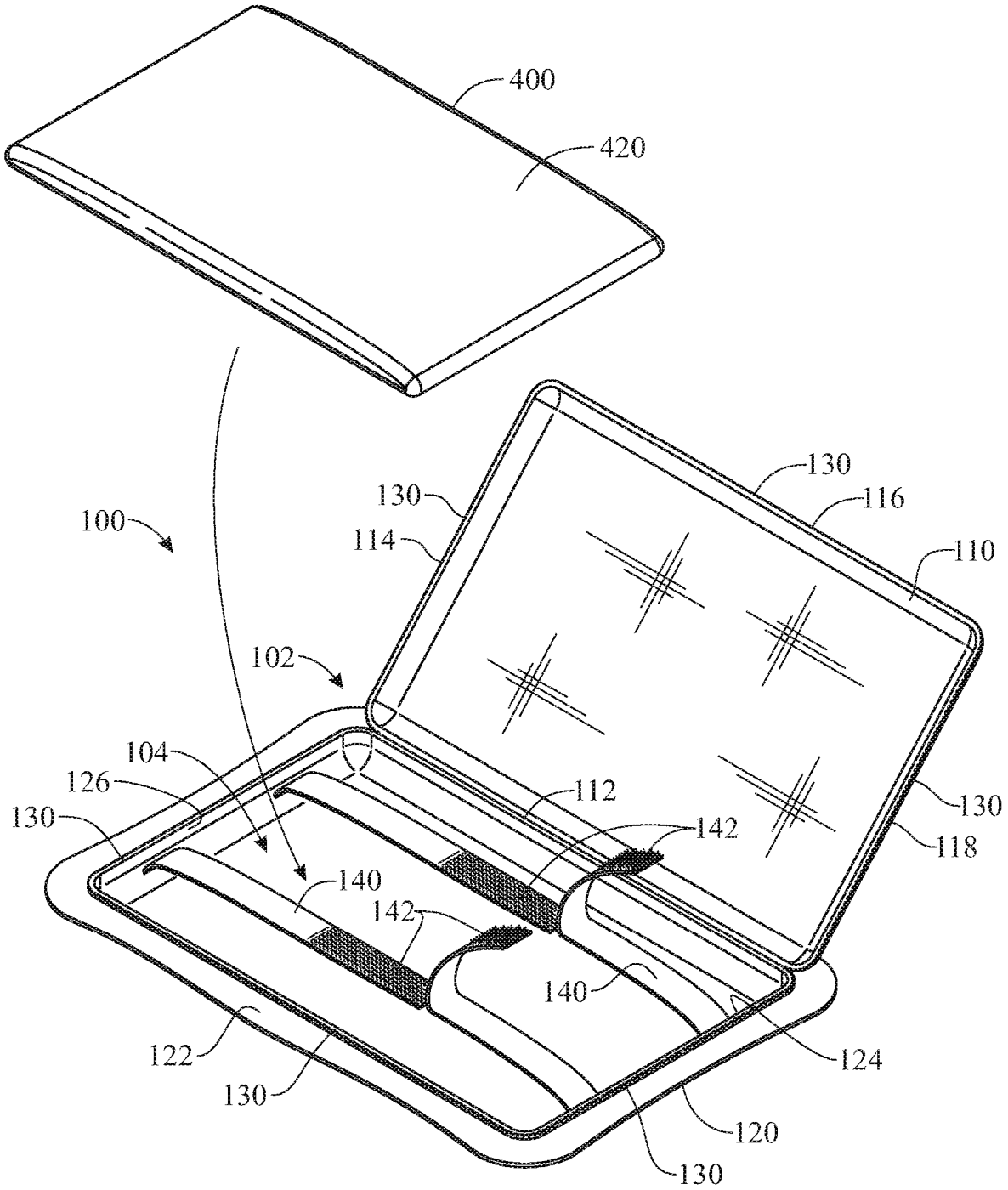
FIG. 4 presents a top isometric, exploded view of the decorative pillow cover assembly of FIG. 1, showing the sleeping pillow being placed inside the decorative pillow cover.
Figure 5:
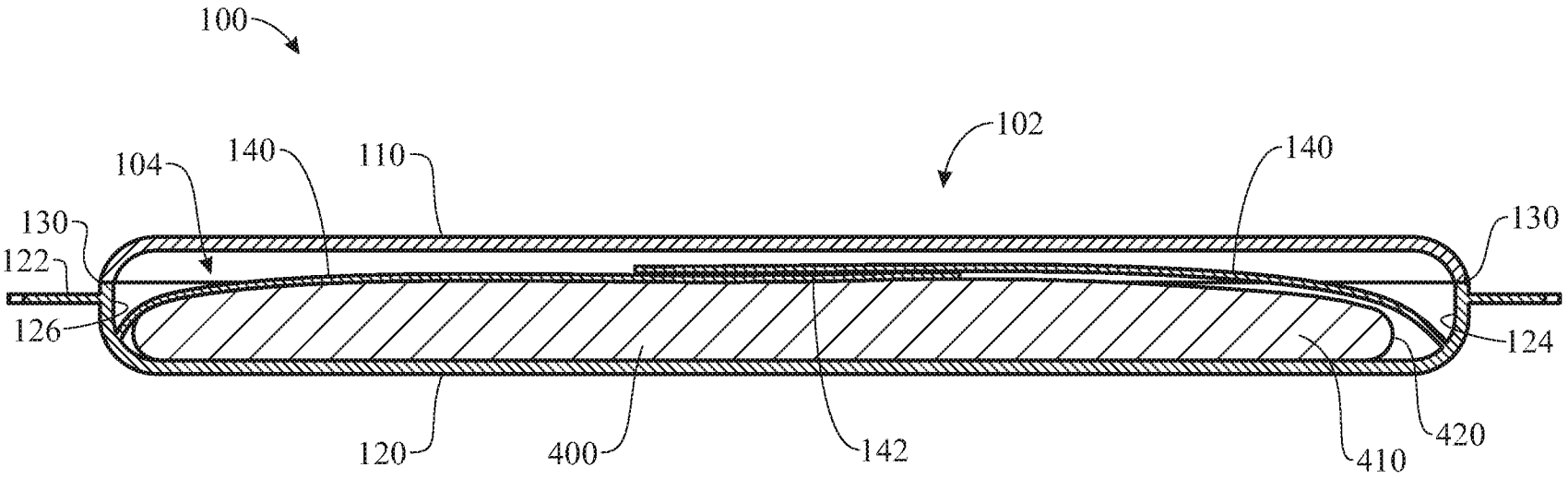
FIG. 5 presents a cross-sectional side elevation view of the decorative pillow cover assembly of FIG. 1, taken along section plane 5-5 indicated in FIG. 1.

Referring initially to FIGS. 1 through 5, a decorative pillow cover assembly 100 is illustrated in accordance with a first embodiment of the present invention. The illustrations of FIGS. 1, 2 and 5 illustrate the decorative pillow cover assembly 100 in a closed state. The illustration of FIG. 1 is a top isometric view of the decorative pillow cover assembly 100 while FIG. 2 is a bottom isometric view of the decorative pillow cover assembly 100; in turn, FIG. 5 shows a cross-sectional side elevation view of the decorative pillow cover assembly 100. As shown in FIGS. 1 and 2, the decorative pillow cover assembly 100 includes a decorative pillow cover 102 consisting of a first cover portion 110 and a second cover portion 120. In the closed state of FIGS. 1, 2 and 5, the first and second cover portions 110, 120 define and enclose an internal space 104 (FIG. 5).

As shown in FIG. 1, the first cover portion 110 has four side edges 112, 114, 116, and 118. The first cover portion 110 is pivotably or hingedly connected with the second cover portion 120 through one of the side edges, and more specifically through side edge 112. The decorative pillow cover 102 further includes a cover securing device for securing the first cover portion 110 to the second cover portion 120 in the closed position of FIG. 1; specifically, the cover securing device of the present embodiment is a zipper 130, shown in FIG. 3. The zipper 130 is provided at the other three side edges 114, 116, and 118 of the first cover portion 110 for selectively securing the first cover portion 110 to the second cover portion 120 or freeing the first cover portion 110 to pivot in relation to the second cover portion 120. The second cover portion 120 has an integrally-formed peripheral flap 122 extending outwardly beyond the zipper 130. The zipper 130 is preferably concealed by a cloth edge, strip, rim or the like, so that it is not visible to the outside observer. Other attachment devices such as a hook-and-loop attachment device or a snap attachment device can be used in place of the zipper. The decorative pillow cover 102 can be made of any materials such as cotton, silk, etc.

The illustrations of FIGS. 3 and 4 show the decorative pillow cover assembly 100 in an open state. As shown in FIG. 3, two strap fasteners 140 extend from opposite sides 124, 126 of the second cover portion 120. The two strap fasteners 140 provide a pillow securing device for securing a sleeping pillow 400 (preferably of the type formed by a pillow 410 and a pillowcase 420 encasing the pillow 410, better shown in FIG. 5) inside the internal space 104 between the first cover portion 110 and the second cover portion 120, and minimizing or preventing movement of the sleeping pillow 400 within the internal space 104. It is noted that one strap fastener 140 or more than two strap fasteners 140 can also be used in alternative embodiments of the invention. It is further noted that the strap fasteners 140 are preferably adjustable so that sleeping pillows of different sizes can be secured inside the decorative pillow cover assembly 100 in a stable way and the sleeping pillows can remain centered within the internal space 104 of the decorative pillow cover assembly 100. For example, in some embodiments the strap fasteners 140 can be fastened to different lengths, such as by adjusting a hook-and-loop fastening device 142 (FIG. 4) provided on the strap fasteners 140, for instance and without limitation. Alternatively or additionally, the strap fasteners 140 can be made of elastic material so that the fasteners 140 can be adapted to sleeping pillows of different sizes. The strap fasteners 140 are preferably as thin and flexible as possible, so they do not provide a bulky feeling to the pillow and are not visible from outside.

As mentioned heretofore, the illustration of FIG. 5 is a cross-sectional view illustrating the decorative pillow cover assembly 100 of the first embodiment in a closed state, with the sleeping pillow 400 in the internal space 104 by the strap fasteners 140, and concealed by the first and second cover portions 110, 120. The decorative pillow cover assembly 100 together with the sleeping pillow 400 (formed by pillow 410 and pillowcase 420) secured therein now functions as a decorative pillow.

The process of converting a sleeping pillow into a decorative pillow using the decorative pillow cover assembly 100 of is as follows. First, a decorative pillow cover assembly 100 as described above is provided. A user unzips the zipper 130 and pivots the first cover portion 110 to an open position as shown in FIG. 4. A sleeping pillow 400 (of the type formed by a pillow 410 and a pillowcase 420 usable for resting the head while sleeping) is then placed in the internal space 104 of decorative pillow cover 102, and secured by attaching the strap fasteners 140 to an appropriate length. After the sleeping pillow 400 has been properly secured inside the decorative pillow cover 102, the first cover portion 110 and the second cover portion 120 are brought to the closed position and secured to one another by zipping the zipper 130.

The above process can be reversed when converting a decorative pillow into a sleeping pillow. First, the decorative pillow cover 102 can be opened by unzipping the zipper 130. The sleeping pillow 400 inside the decorative pillow cover 102 can then be retrieved for sleeping by unfastening the strap fasteners 140 and removing the sleeping pillow 400 from the internal space 104. The decorative pillow cover 202 can then be set aside or stored, while the sleeping pillow 400 is used for sleeping.

Figure 6:
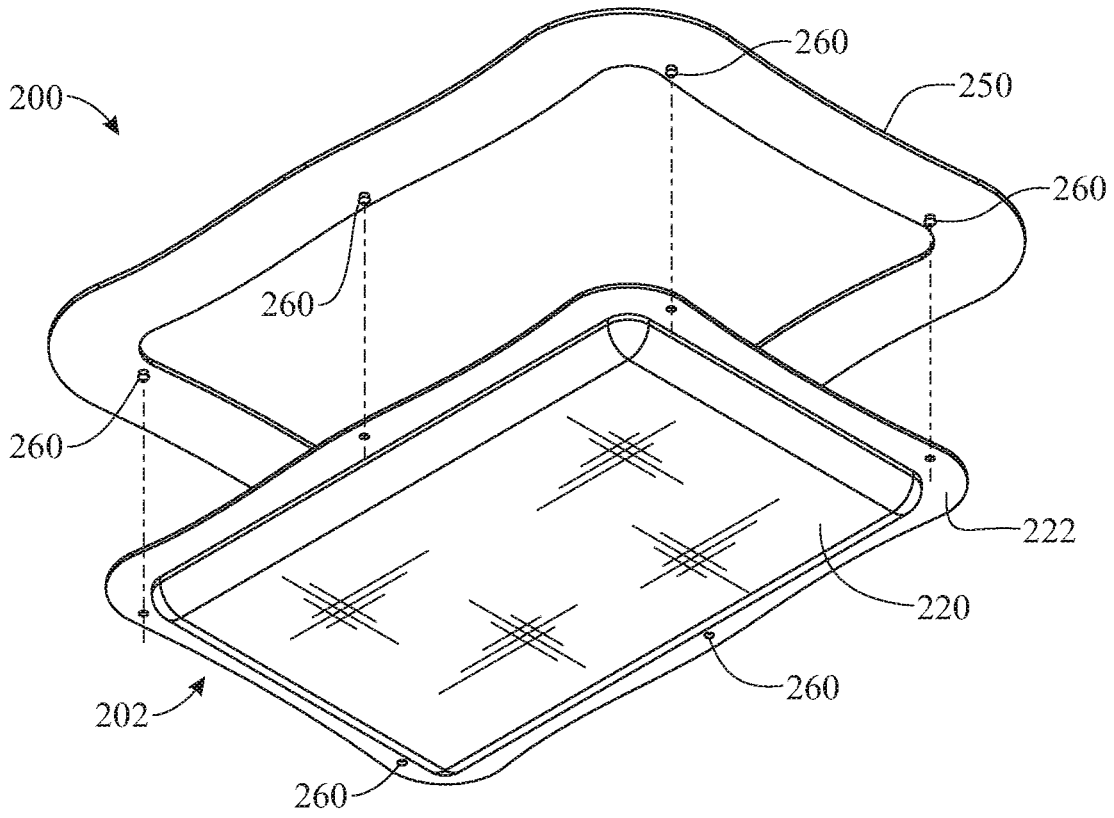
FIG. 6 presents a bottom, exploded isometric view of a decorative pillow cover assembly in accordance with a second exemplary of the present invention, where a peripheral decorative flap is being attached to a periphery of the decorative pillow cover.
Figure 7:
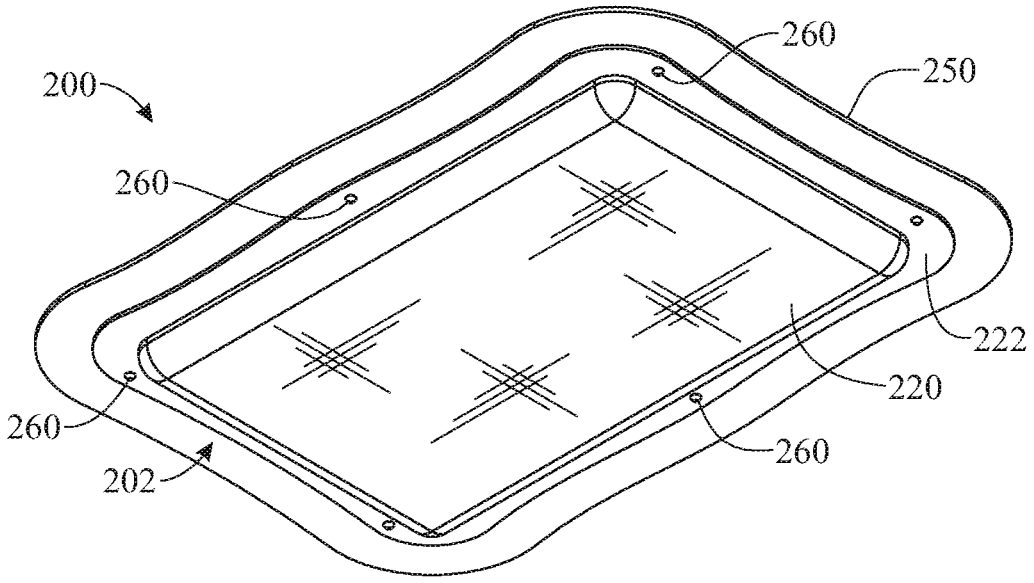
FIG. 7 presents a bottom isometric view of the decorative pillow cover assembly of FIG. 6, shown assembled, with the peripheral decorative flap attached to the periphery of the decorative pillow cover.

Referring now to FIGS. 6 and 7, a decorative pillow cover assembly 200 is illustrated in accordance with a second embodiment of the present invention. Like features of the decorative pillow cover assembly 200 and the decorative pillow cover assembly 100 (FIGS. 1 through 5) are numbered the same except preceded by the numeral '2'. In this embodiment, the decorative pillow cover assembly 200 includes a decorative pillow cover 202 which is equal to the decorative pillow cover 102 of the first embodiment plus a peripheral decorative flap 250 which can be removably attached to the peripheral flap 222 of the decorative pillow cover 202. For example, as shown, the peripheral decorative flap 250 can be attached to the peripheral flap 222 of the decorative pillow cover 202 by snap fasteners 260, for instance and without limitation; alternative disconnectable and re-connectable fasteners such as buttons, magnets, hook-and-loop fasteners or the like may be used to attach the peripheral decorative flap 250 to the peripheral flap 222. Different peripheral decorative flaps can be interchangeably attached to the decorative pillow cover 202, allowing a user to change the aspect of the decorative pillow cover assembly 200 in dependence of their needs or desires. For instance, a user may replace an existing peripheral decorative flap with a different color peripheral decorative flap when redecorating their bedroom. The user may also choose not to attach a peripheral decorative flap 250 to the periphery of the decorative pillow cover 202.

Figure 8:
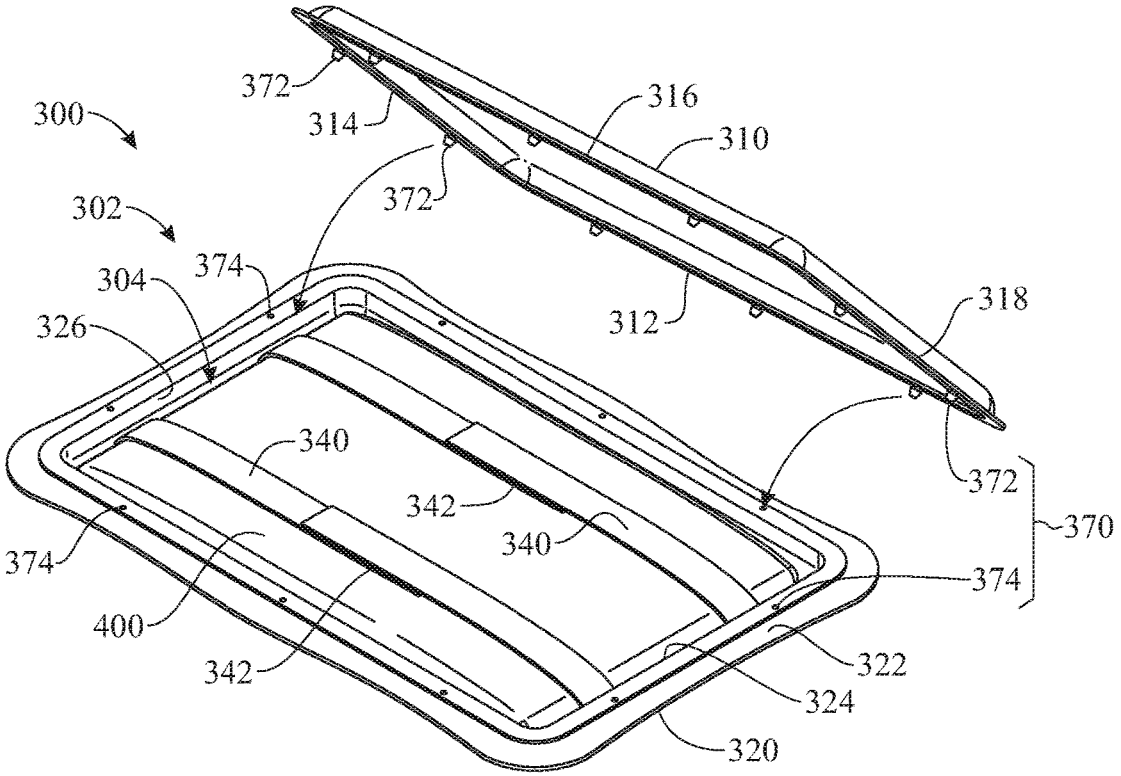
FIG. 8 presents a top isometric view of a decorative pillow cover assembly in accordance with a third exemplary embodiment of the present invention, the decorative pillow cover assembly show in an open, un-snapped position revealing an internal space housing a sleeping pillow.
Figure 9:
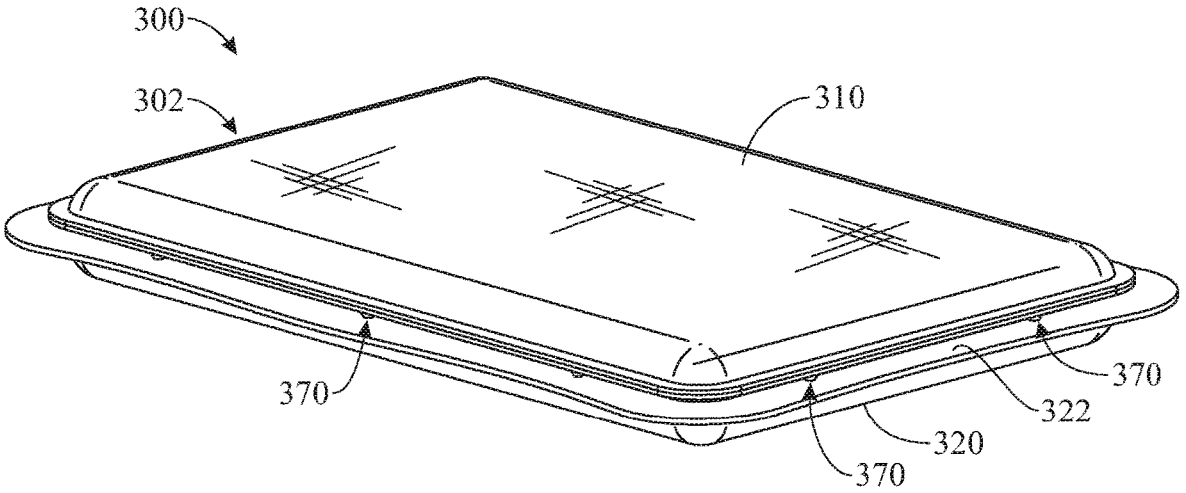
FIG. 9 presents a top isometric view of the decorative pillow cover assembly of FIG. 8, the decorative pillow cover assembly shown in a closed, snapped position concealing the internal space and the sleeping pillow.

The illustrations of FIGS. 8 and 9 show a decorative pillow cover assembly 300 in accordance with a third embodiment of the present invention. Like features of the decorative pillow cover assembly 300 and the decorative pillow cover assembly 100 (FIGS. 1 through 5) are numbered the same except preceded by the numeral '3'. As shown, the decorative pillow cover assembly 300 comprises a decorative pillow cover 302 having a first cover portion 310 and a second cover portion 320. The first cover portion 310 has four side edges 312, 314, 316, and 318. Similarly to the previous embodiments, the first and second cover portions 310, 320 can adopt an attached, closed position in which the first and second cover portions 310, 320 enclose an internal space 304. The decorative pillow cover 302 further includes a peripheral flap 322. Internal strap fasteners 340 extend from opposite inner sides 324, 326 of the second cover portion 320 to secure a sleeping pillow 400 in the internal space 304.

The present embodiment is different from the first and second embodiments in that the first cover portion 310 is detachable from the second cover portion 320 along all four side edges 312, 314, 316, and 318 of the first cover portion 310. In other words, the first cover portion 310 is completely detachable and removable from the second cover portion 320. Similarly to the previous embodiments, the decorative pillow cover 302 includes a cover securing device for securing the first cover portion 310 to the second cover portion 320 in a closed position. However, the present embodiment is different from the previous embodiments in that the cover securing device of the present embodiment is a set of snap fasteners 370 instead of a zipper. Each snap fastener 370 is formed of a first snap fastener portion 372 comprised in the first cover portion 310 and a corresponding second snap fastener portion 374 comprised in the second cover portion 320. As shown in FIG. 8, the snap fasteners 370 can adopt an unsnapped position allowing the first cover portion 310 to detach and separate from the second cover portion 320, thus providing access to the internal space 304 and strap fasteners 340 for inserting or removing a sleeping pillow 400 into or from the internal space 304. In addition, as shown in FIG. 9, the snap fasteners 370 can adopt a snapped configuration securing the first cover portion 310 to the second cover portion 320 and thus concealing the sleeping pillow 400, internal space 304 and strap fasteners 340.

In the present embodiment, the snap fasteners 370 are arranged along all four sides of the first and second cover portions 310, 320. However, alternative embodiments are contemplated in which snap fasteners may be arranged only on some of the sides of the first and second cover portions. It is also contemplated that alternative discrete fasteners such as magnets, buttons or hook-and-loop portions may be used in addition to, or instead of, snap fasteners. In some embodiments, snap fasteners, magnets, buttons or other discrete fasteners may be used in combination with one or more zippers.

Figure 10:
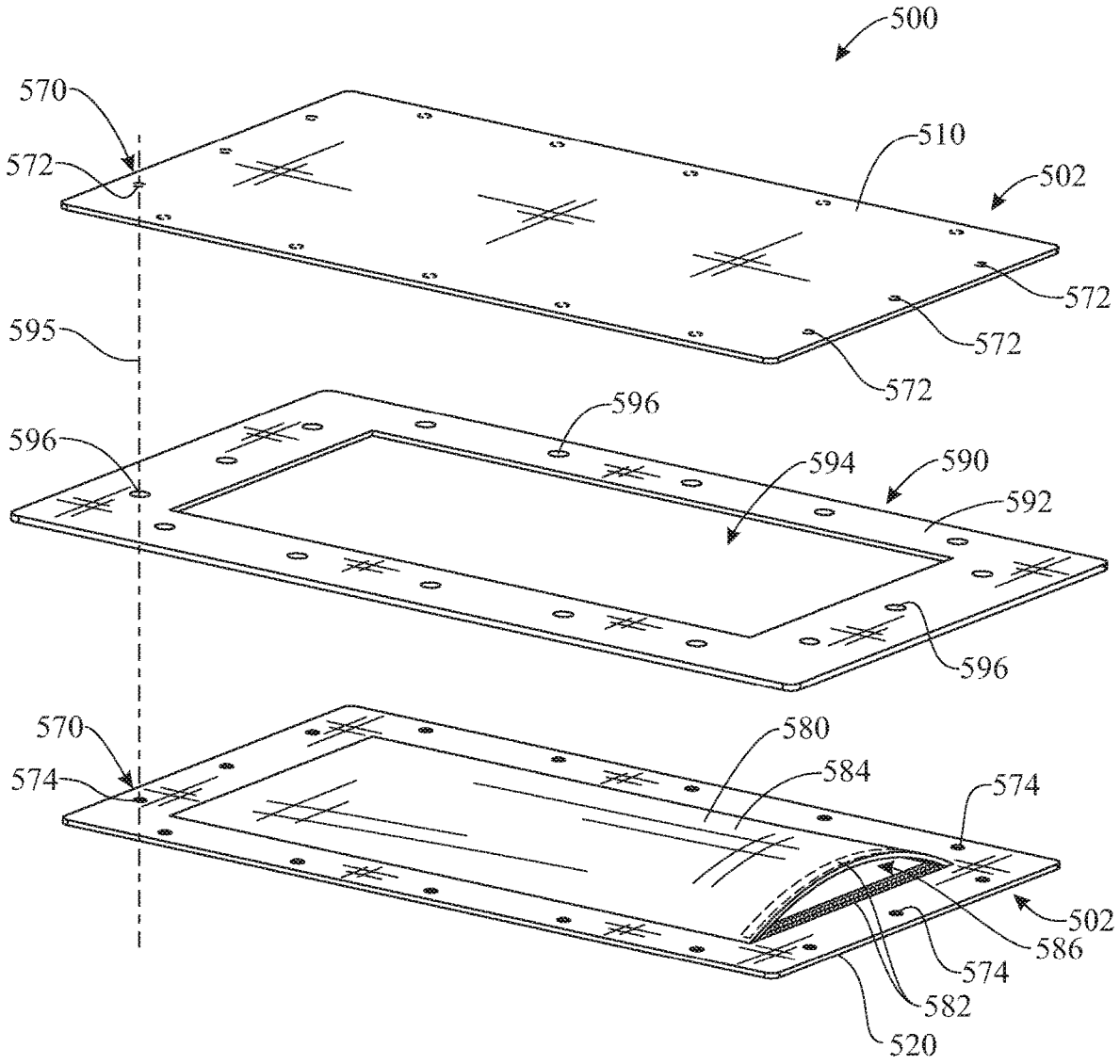
FIG. 10 presents a top isometric exploded view of a decorative pillow cover assembly in accordance with a fourth exemplary embodiment of the present invention, the decorative pillow cover assembly comprising a decorative frame sandwiched between the first and second cover portions.
Figure 11:
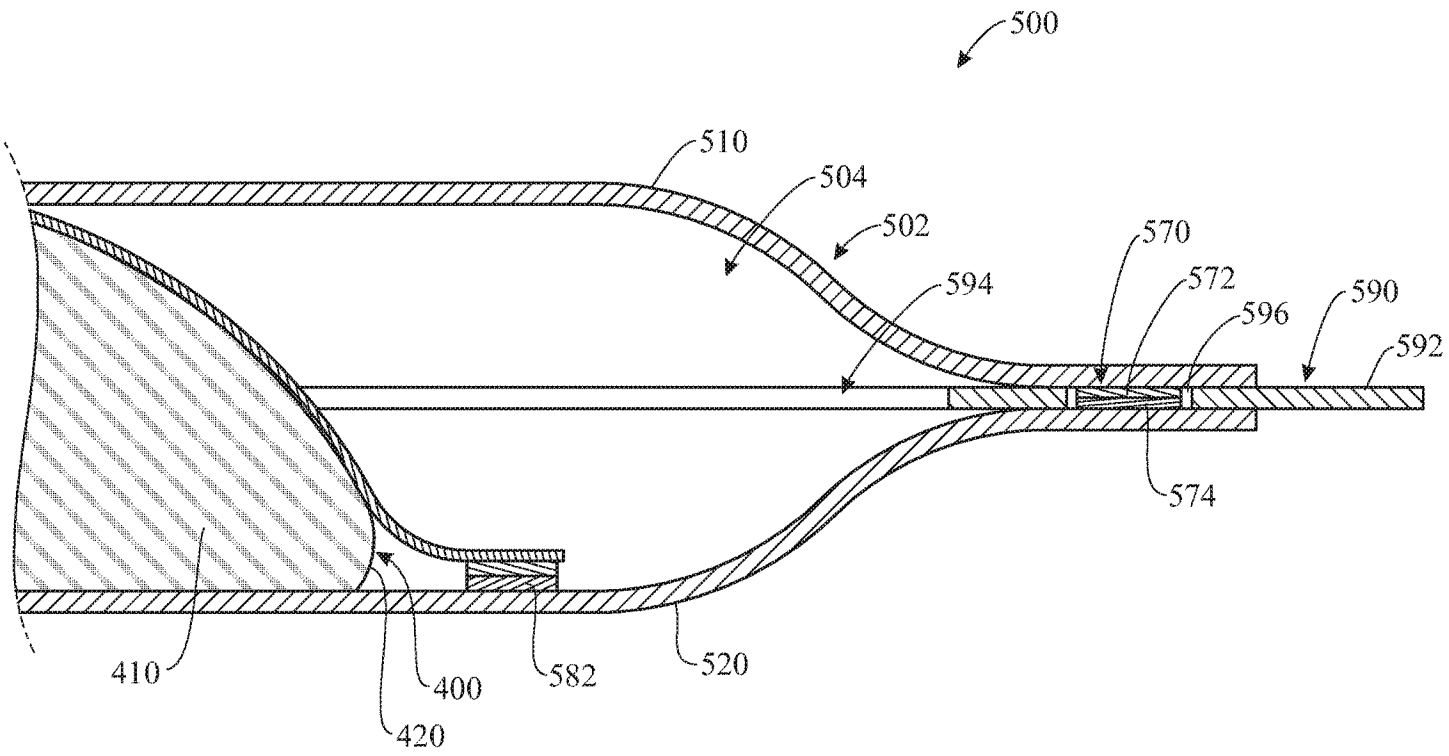
FIG. 11 presents a partial cross-sectional side elevation view of the decorative pillow cover assembly of FIG. 10, shown assembled.

The illustrations of FIGS. 10 and 11 show a decorative pillow cover assembly 500 in accordance with a fourth embodiment of the present invention. Like features of the decorative pillow cover assembly 500 and the decorative pillow cover assembly 100 (FIGS. 1 through 5) are numbered the same except preceded by the numeral '5'. Similarly to the previous embodiments, the decorative pillow cover assembly 500 comprises a decorative pillow cover 502 including a first cover portion 510 and a second cover portion 520 which can be attached to one another to form a casing. Similarly to the decorative pillow cover assembly 300 of FIGS. 8 and 9, the first cover portion 510 and the second cover portion 520 are completely disconnectable and separable from one another, and can be reversibly disconnected and re-connected to one another.

Also similarly to previous embodiments, the decorative pillow cover assembly 500 comprises a pillow retainer or pillow securing device 580 formed on an internal surface of the second cover portion 520 for securing a sleeping pillow inside an internal space 504 formed between the first cover portion 510 and the second cover portion 520. For instance, the illustration of FIG. 11 shows a sleeping pillow 400, of the type comprising a pillow 410 and a pillowcase 420 encasing the pillow 410, housed within the internal space 504. However, unlike the previous embodiments, the pillow securing device 580 comprises a panel 584 defining a pocket having a pocket space 586 configured to receive the sleeping pillow 400. As shown, at least one fastener 582 can be provided at one or more edges of the panel 584 to close the edge(s) of the panel 584 and retain the sleeping pillow 400 therewithin and against the second cover potion 520, as shown in FIG. 11.

As in the embodiments of FIGS. 1-9, the decorative pillow cover assembly 500 further includes at least one cover fastener or cover securing device provided along edges of the first cover portion 510 and the second cover portion 520 for disconnectably securing the edges of the first cover portion 510 and the second cover portion 520 together and enclosing the internal space 504 and the pillow securing device 580. Similarly to the embodiment of FIGS. 8 and 9, the cover securing device comprises a plurality of snap fasteners 570 formed by first snap fastener portions 572 and corresponding second snap fastener portions 574, respectively carried by the first cover portion 510 and second cover portion 520, such that each first fastener portion 572 is in registration with, and configured to disconnectably attach to, a corresponding second snap fastener portion 574. As shown, the plurality of snap fasteners 570 extends edges of all four sides of the first cover portion 510 and the second cover portion 520. Alternatively or additionally, the cover securing device can include other disconnectable and re-connectable fasteners such as magnets, hook-and-loop fasteners, buttons or the like.

In some embodiments of the invention, the decorative pillow cover assembly can further include a decorative frame comprising a set of one or more openings for the passing therethrough of the cover securing device. For instance, the decorative pillow cover assembly 500 of the present embodiment comprises a decorative frame 590 (made, for instance, of fabric, plastic or other applicable decorative materials or combinations thereof) comprising a rectangular frame body 592 having a central opening 594. A plurality of through holes 596 are formed through the frame body 592, as shown. The through holes 596 are shaped and sized slightly larger than the snap fasteners 570 and are in registration with the snap fasteners 570 as indicated with broken line 595 in FIG. 10. As shown in FIG. 11, the decorative pillow cover assembly 500 can adopt an assembled configuration in which the decorative frame 590 is sandwiched between the first cover portion 510 and the second cover portion 520, i.e. is placed between the first cover portion 510 and second cover portion 520. In this assembled configuration, each snap fastener 570 extends through a corresponding through hole 596 and the first and second snap fastener portions 572 and 574 are attached to one another, securing the first cover portion 510 to the second cover portion 520 and further securing the frame 590 to the decorative pillow cover 502. The frame 590 can be easily removed from in between the first cover portion 510 and second cover portion 520 by pulling the first and second cover portions 510 and 520 apart and unsnapping the snap fasteners 570.

In some embodiments of the invention, the first cover portion and the second cover portion of the decorative pillow cover can be made of different materials relative to one another. For instance, one of the first cover portion and the second cover portion can be made of a soft, skin-compatible material, ideal for the resting thereon of the head or face, while the other of the first cover portion and the second cover portion can be made in any other applicable material including decorative indicia, items, objects, patterns, etc. The decorative pillow cover assembly can then be flipped over to serve as a sleeping pillow (by having the softer side of the first and second cover portions face up) or decorative pillow (by having the other, decorative side of the first and second cover portions face up), without having to remove the pillow lodged inside the decorative pillow cover.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A decorative pillow cover assembly for converting a sleeping pillow into a decorative pillow, comprising:

a decorative pillow cover including a first cover portion and a second cover portion;

a pillow securing device formed on an internal surface of the second cover portion for securing a sleeping pillow inside an internal space formed between the first cover portion and the second cover portion;

a cover securing device provided along edges of the first cover portion and the second cover portion for disconnectably securing the edges of the first cover portion and the second cover portion together and enclosing the internal space and the pillow securing device and a decorative frame comprising a set of one or more openings for the passing therethrough of the cover securing device; wherein the decorative pillow cover assembly is configured to adopt:

an assembled configuration in which the decorative frame is sandwiched between the first cover portion and the second cover portion and the cover securing device extends through the set of one or more openings securing the first cover portion to the second cover portion and securing the frame to the decorative pillow cover, and a disassembled configuration in which the cover securing device is disconnected allowing the removal of the frame from in between the first cover portion and second cover portion.

2. The decorative pillow cover assembly of claim 1, further comprising a sleeping pillow comprising a pillowcase and a pillow encased within the pillowcase, wherein the sleeping pillow is arranged within the internal space and retained adjacent to the second cover portion by the pillow securing device.

3. The decorative pillow cover assembly of claim 1, wherein the first cover portion and the second cover portion are foldably connected to one another.

4. The decorative pillow cover assembly of claim 1, wherein the first cover portion and the second cover portion are separably and re-connectably connected to one another.

5. The decorative pillow cover assembly of claim 1, wherein the pillow securing device comprises one or more flexible strap fasteners.

6. The decorative pillow cover assembly of claim 5, wherein the strap fasteners are adjustable.

7. The decorative pillow cover assembly of claim 1, wherein the pillow securing device comprises a panel forming a pocket configured to receive the sleeping pillow therewithin.

8. The decorative pillow cover assembly of claim 1, wherein the cover securing device comprises a zipper.

9. The decorative pillow cover assembly of claim 1, wherein the cover securing device comprises a snap fastener.

10. The decorative pillow cover assembly of claim 1, wherein the first cover portion and the second cover portion are connected at one side thereof, and the cover securing device is provided along edges of the remaining sides of the first cover portion and the second cover portion.

11. The decorative pillow cover assembly of claim 1, wherein the cover securing device is provided along edges of all sides of the first cover portion and the second cover portion.

12. The decorative pillow cover assembly of claim 1, wherein the decorative pillow cover assembly further comprises a peripheral flap removably attachable to a periphery of the decorative pillow cover.

13. The decorative pillow cover assembly of claim 12, wherein the peripheral flap is removably attachable to the periphery of the decorative pillow cover by snap fasteners.

14. A decorative pillow cover assembly for converting a sleeping pillow into a decorative pillow, comprising:

a sleeping pillow comprising a pillow and a pillowcase encasing the pillow;

a decorative pillow cover comprising a first cover portion, a second cover portion, a pillow securing device formed on the second cover portion facing the first cover portion, a cover securing device provided along edges of the first cover portion and the second cover portion for disconnectably securing the edges of the first cover portion and the second cover portion together and enclosing an internal space therebetween and further enclosing the pillow securing device, and a decorative frame comprising a set of one or more openings for the passing therethrough of the cover securing device; wherein the decorative pillow cover assembly is configured to adopt:

a decorative configuration in which the sleeping pillow is housed within the internal space of the decorative pillow cover and retained against the second cover portion by the pillow securing device, and in which the first cover portion and second cover portion are attached to one another by the cover securing device, thereby enclosing the sleeping pillow, and further in which the decorative frame is sandwiched between the first cover portion and the second cover portion securing the frame to the decorative pillow cover, and the cover securing device extends through the set of one or more openings;

an open configuration in which the cover securing device is disconnected, the first cover portion and second cover portion are moved away from one another, and the pillow securing device is released allowing the removal of the sleeping pillow to be used for resting a user's head thereon for sleeping.

15. The decorative pillow cover of claim 14, wherein the first cover portion and the second cover portion each have four corresponding sides, wherein the first and second cover portion are foldably connected on one side thereof, and further wherein the cover securing device is provided along the remaining three sides of the first cover portion and second cover portion.

16. The decorative pillow cover of claim 14, wherein the first cover portion and the second cover portion each have four corresponding sides, wherein the cover securing device is provided along all four sides of the first cover portion and the second cover portion, and further wherein the first cover portion and the second cover portion are fully disconnectable and separable from one another.

17. A decorative pillow cover assembly for converting a sleeping pillow into a decorative pillow, comprising:

a sleeping pillow comprising a pillow and a pillowcase encasing the pillow;

a decorative pillow cover comprising a first cover portion, a second cover portion, at least one pillow retainer formed on the second cover portion facing the first cover portion, at least one cover fastener provided along edges of the first cover portion and the second cover portion for disconnectably securing the edges of the first cover portion and the second cover portion together and enclosing an internal space therebetween and further enclosing the pillow retainer, and a decorative frame comprising a set of one or more openings for the passing therethrough of the at least one cover fastener; wherein the decorative pillow cover assembly is configured to selectively adopt:

a decorative configuration in which the sleeping pillow is housed within the internal space of the decorative pillow cover and retained against the second cover portion by the pillow retainer, and in which the first cover portion and second cover portion are attached to one another by the at least one cover fastener, thereby enclosing the sleeping pillow, and further in which the decorative frame is sandwiched between the first cover portion and the second cover portion securing the frame to the decorative pillow cover, and the at least one cover fastener extends through the set of one or more openings;

an open configuration in which the at least one cover fastener is disconnected, the first cover portion and second cover portion are moved away from one another, and the pillow retainer is released allowing the removal of the sleeping pillow to be used for resting a user's head thereon for sleeping.

18. The decorative pillow cover assembly of claim 17, wherein the pillow retainer comprises one or more flexible straps extending from the second cover portion.

19. The decorative pillow cover assembly of claim 17, wherein the pillow retainer comprises a panel defining a pocket configured to receive the sleeping pillow therewithin.

* * * * *